US005125115A

United States Patent [19]

Lincoln

[11] Patent Number: 5,125,115

[45] Date of Patent: Jun. 30, 1992

[54] SUN-SHIELDING VENTILATED GLOVE

[76] Inventor: Robert A. Lincoln, 8325 Murphy Rd., Laurel, Md. 20723

[21] Appl. No.: 478,916

[22] Filed: Feb. 12, 1990

[51] Int. Cl.[5] ..... A41D 19/00

[52] U.S. Cl. ..... 2/159

[58] Field of Search ..... 2/16, 20, 158, 161 R, 2/159, 161 A

[56] References Cited

U.S. PATENT DOCUMENTS

| | | | |
|---|---|---|---|
| D. 299,562 | 1/1989 | Lee | 2/16 X |
| 356,385 | 1/1887 | Waterhouse | 2/20 X |
| 894,311 | 7/1908 | Brenton | 2/20 X |
| 1,486,006 | 3/1924 | Blom | 2/20 X |
| 1,962,258 | 6/1934 | Okuda | 2/20 |
| 2,474,535 | 6/1949 | Krannak | 15/227 X |
| 3,446,880 | 5/1969 | Enicks | 2/16 X |
| 4,675,913 | 6/1987 | Rockwell | 2/161 R |
| 4,785,478 | 11/1988 | Mosley | 2/167 X |
| 4,809,366 | 3/1989 | Pratt | 2/20 X |
| 4,907,297 | 3/1990 | Gallucci | 2/163 |

FOREIGN PATENT DOCUMENTS

| | | | |
|---|---|---|---|
| 335837 | 10/1930 | United Kingdom | 2/158 |

*Primary Examiner*—Werner H. Schroeder
*Assistant Examiner*—Sara M. Current

[57] ABSTRACT

The invention is a glove-like device which shields the back of the hands from the rays of sunlight. It fits over the back of the hand like a glove, but leaves the palm and sides of the hand and the sides of the fingers and thumb essentially uncovered so heat from the hand can easily escape and the hand can be cooler. Unlike ordinary gloves which would be too uncomfortable to be worn in warm or hot surroundings because they retain the heat coming from the hands, the invention provides ventilation for the hands and allows them to stay cool while the device is being worn in the hot summer sun, or in warm surroundings, such as the inside of an air conditioned automobile, where one would not want to wear ordinary gloves to shield the sunlight off the hands. The sun-shielding device is held on the hand by portions which slip over the ends of the fingers and the thumb, strips of material which go around the fingers and thumb, one or more strips which go across the palm of the hand, and an adjustable band which goes around the wrist. The shield portion over the back of the hand can be made of various materials which block the passage of rays of sunlight. The portion that wraps around the palm side to hold the device on the hand can be made of various materials which will hold the shield portion in place while allowing heat to escape freely from around the palm side of the hand. The device also allows heat to escape from under the shield as the hand is flexed during normal movement or grasping.

10 Claims, 1 Drawing Sheet

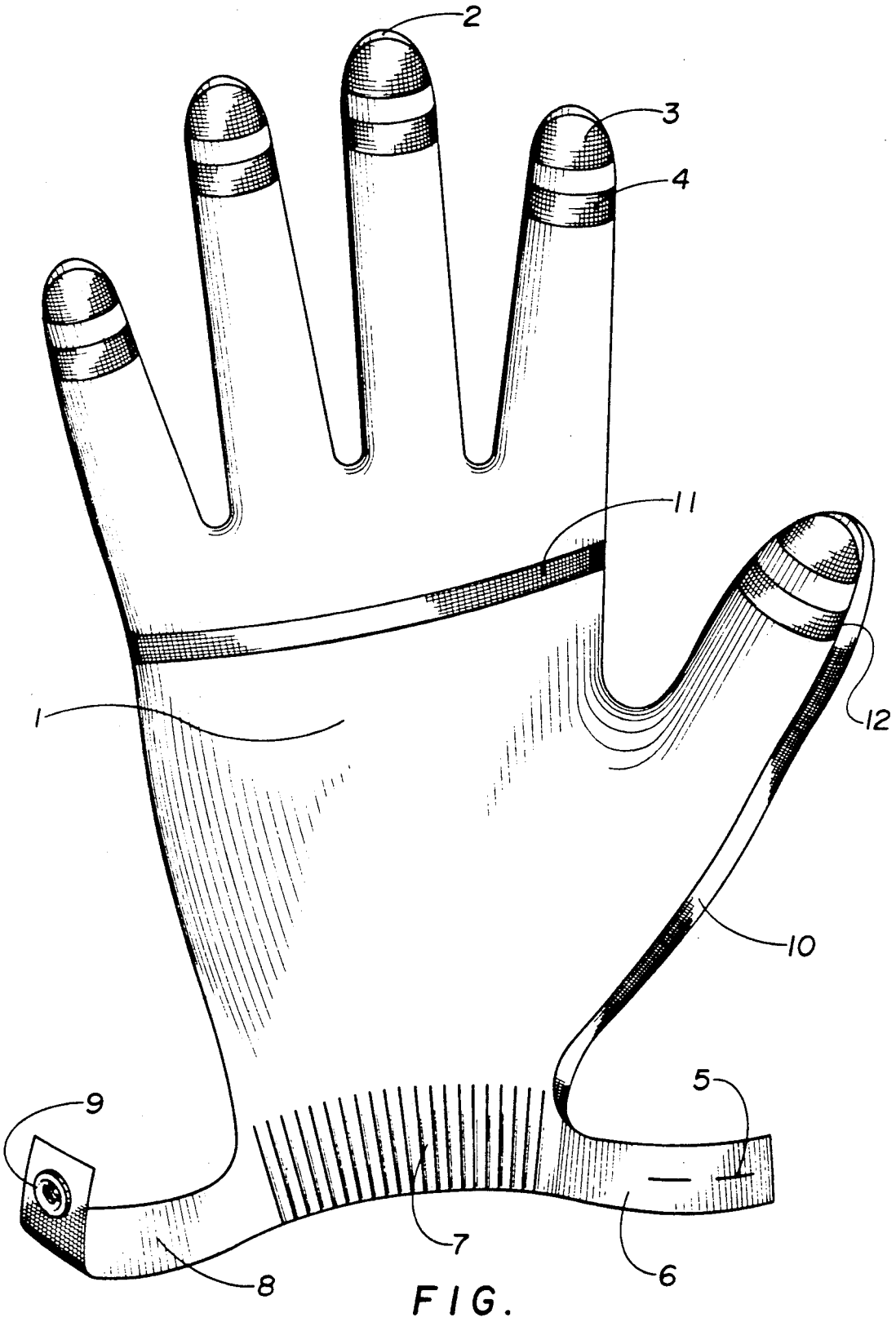
FIG.

SUN-SHIELDING VENTILATED GLOVE

BACKGROUND OF THE INVENTION

Hand coverings or gloves have been used by people as long ago as recorded time, and probably since people began to wear animal skin or other body coverings for protection.

Many gloves can do the same thing, but some gloves do something better or differently than others. Most gloves are designed to do one or two things. One thing that most gloves do as their primary purpose or as an added effect is to make the hands warmer than they would be if the gloves were not worn.

Many special-purpose gloves have been developed. For example, gloves to keep warm, to protect from heat or sparks, to aid in holding a golf club or ball bat, or to provide assistance in swimming.

Most gloves protect the hands from the elements, substances, atmosphere, or environment surrounding them. However, there are no gloves which protect the hands from sunlight while at the same time allowing them to be cool when the gloves are worn in a warm environment—unless one were to add a coolant to the gloves.

The effect of sunlight on the skin of the human body is becoming increasingly more important as the atmospheric shield of the earth is becoming less effective in screening out harmful rays of light and such light reaches the surface of the earth and the people inhabiting it.

During normal everyday activity when the usual everyday clothes are being worn, two parts of the body are subject to greater exposure than any other parts. They are the hands and the face. Of these two parts, the face gets the greater protection in warmer climates where gloves are not normally worn as a part of the usual outdoors clothing, either all year or during that part of the year when the temperature is warmer. The face is protected from the sunlight by hat brims, cap visors, the angles of the sunlight striking at lesser degrees, by ones turning the face downward away from the sun, by one's hair, etc. During these normal conditions, the one part of the body left unprotected is the hand or hands. Nothing must has been done to protect the hands from sunlight. During warm or hot seasons when the sunlight is most intense, gloves are usually not worn because they cause the hands to overheat, sweat, and become uncomfortable. Thus, the hands are unprotected from the harmful rays of sunlight. My invention greatly reduces the heat retention of the gloves and thus eliminates the discomfort of wearing gloves when the temperature of the air around the body is warm or hot.

The sunlight does not strike all parts of the hands in an equal amount. More light rays hit the backs of the hands. In fact, very little hits the palm side of the hands, as they are normally turned away from the sun. When one walks, the hands are at the sides of the body with the palms turned toward the body. When one runs, the hands are clenched and the backs of the hands are exposed to sunlight. When one holds a hammer or other handtool, the hand wraps around the tool and the back of the hand is exposed to the direct sunlight. When one drives an automobile, the hands grip around the steering wheel and the backs of the hands are exposed to the sunlight. In doing almost any normal activity the backs of the hands are the parts that are exposed to the direct sunlight because of the way the hands are attached to the body and because of the way they hold things.

SUMMARY OF THE INVENTION

My invention is a device or glove which protects the hands from the light of the sun while at the same time it keeps the hands from getting hotter because it allows most of the heat coming out of the body to escape, and disallows heat from the sun to be absorbed by the hands. The invention allows one to have ventilation of the hand surface while at the same time protecting the back of the hand from exposure to direct sunlight.

My invention utilizes a fabric, reflective film or other material which is capable of reflecting, blocking, resisting, or reducing the passage of sunlight to cover the back of the hands, and combines that portion with a portion which does over the other side or palm portion of the hands to hold the device on the hands. The portion which goes over across the palm side of the hands is minimized to the extent considered necessary to achieve the ventilation desired while taking into consideration other purposes one might wish to achieve. Thus, if one wanted to grip something tightly and wanted a degree of protection for the palm, one could use an open mesh made of leather or strong fabric. If one wanted to do things such as walking, running, or driving, one could have the palm almost completely uncovered. If one desired the glove to be held more securely on the hand, a strip or two going across the palm could be added.

The greatest use of my invention is for protecting the hands, because they receive the greatest exposure to sunlight. However, the device can be enlarged or extended to cover the wrists and the arms, because they too may be exposed to too much sunlight.

BRIEF DESCRIPTION OF THE DRAWINGS

The FIGURE is a frontal perspective view of a preferred embodiment of the device in accordance with my invention. This is a view of the device as it would appear as one were about to put it on one's right hand with the palm of the hand toward the viewer and with the fingers of the hand pointing upward. This drawing shows the side of the glove-like device which would be against the back of the hand and strip-like portions which would come across the palm of the hand and the palm side of each finger and thumb. A strap for securing the device to the wrist is also shown.

DESCRIPTION OF THE PREFERRED EMBODIMENTS

Referring to the FIGURE, a sun-shielding, ventilated, glove-like device which is worn on the hand of a person, includes an inside portion 1 which lays near or against the skin on the back of the hand, the back of the fingers and thumb, and the back of the wrist. The other side of the device, the outside portion 10, is partially shown as it would come around the side of the thumb to cover the thumb's side. This outside portion 10 is exposed to the sunlight when the sun-shield is being worn on the hand.

The inside portion 1 and the outside portion 10, as shown are the opposite sides of one layer of material. However, this portion of the device could be constructed of more than one layer. The layer of material, as shown, shows no spaces in it for any ventilation through the material. However, loosely woven, but still sun-shielding, material which provided significant additional ventilation could be used. Similarly, if a material such as leather was used, slits could be cut in the layer to allow some air through, but still restrict the passage of an undesirable amount of sunlight.

The sun-shield is held on the hand by a fingertip portion 3 which wraps around each of the fingertips and the tip of the thumb, and by strips 4 which wrap around the fingers and the thumb near their first joint. These strips 4 and strip 11 can be attached to the side edges of the sun-shield as can be seen at point of attachment 12. A strip 11 comes across the palm of the hand to further secure the sun-shield to the hand. This strip 11 need not be worn across the palm of the hand, but at the option of the wearer, can be allowed to lay on the back of the hand and act as a spacer between the sun-shield and the skin to provide additional ventilation between the sun-shield and the skin. The strips 4 and strip 11 can be made of elastic material to provide for a more secure binding of the sun-shield to the hand; but, nonelastic material will hold the sun-shield in place for many types of activities. More strips can be added to achieve a more secure attachment; however, each strip added increases the hat retention factor for the device. These strips can also be made of VELCRO like materials (self-attaching material) to provide for more exact adjustment or fit, or for easy optional removeability.

These strips which aid in holding the sun-shield on the hand do somewhat restrict the escape of heat from the hand. To diminish this heat retention, or provide additional ventilation, there are several options. The strips can be perforated, they can be made narrower, or they can be made of mesh or fishnet type material. Another alternative is to replace some or all of the strips and replace them with a fishnet type material. Still another alternative, is to eliminate all of these strips and add an adhesive material or substance around the perimeter of portion 1 of the FIGURE, and press the adhesive against the hand to provide the necessary attachment.

Silts 2 in the portions covering the tips of the fingers and the tip of the thumb allow the fingernails to come through the portion covering the tips of the fingers. This is especially useful for people with long fingernails.

Straps 6 and 8 form a band which wraps around the wrist, a wristband, to securely hold the sun-shield on the hand. The strips are joined together, when the sun-shield is being worn, by a button 9 which goes through button hole 5 or others provided to get the desired band length. Additional buttonholes can be added to provide added means for adjusting the circumferance of the wristband.

An elastic portion 7 stretches when the fingers are bent, and thus enables the wearer to easily bend the fingers without restriction. This elastic portion is optional and is unnecessary if the wristband is worn loosely, or if the sun-shield is being worn in situations which do not require that it be held tightly on the hand.

Various types of wristbands could be used to help secure the device on the hand. For example, VELCRO-like material (self-attaching material), buckles, snaps, or an elastic band.

It is to be understood that the foregoing description relates to exemplary embodiments and variants of my invention set out by way of example, not by way of limitation. Numerous other embodiments and variants are possible without departing from the spirit and scope of the invention, its scope being defined in the appended claims.

I claim:

1. A sun-shielding device for protecting a wearer's hand having a back and a palm, four fingers and a thumb, said device having a hand portion, four finger portions, a thumb portion and a wrist portion, said thumb and finger portions each having a proximate end where they join the hand portion and a distal end proximate a wearer's fingertips when the device is placed on a wearer's hand, said device comprising a sun-shielding portion and cap, strip, and band attachment portions which aid in holding the sun-shielding portion on the hand, said sun-shielding portion being made of material which impedes the passage of light and radiation from the sun and sized and shaped to entirely cover only the back of the wearer's hand, the backs of the wearer's fingers, thumb, and the back of a wearer's wrist, each of the portions covering the back of the wearer's hand, the backs of the fingers and the thumb and the back of the wrist having first and second side edges; where each of the portions for covering the fingers and thumb has, at its distal end, a cap which encloses the tip of the finger or thumb and extends from the distal end toward the proximal end, terminating at a point about one-half inch from the distal end;

each of the finger and thumb portions also having in a space between the cap and the proximate end of the portion for covering the finger or thumb, a strip of material having first and second ends with the first end of the strip attached to the first side edge of each finger and thumb covering portion of the sun-shielding portion and the second end of the strip attached to the second side edge of the finger or thumb covering portion, said strips crossing over the palm side of the wearer's fingers and thumb when the glove is being worn; and the wrist portion of the sun-shielding portion having two bands, each band having two ends, wherein one band is attached at one of its two ends to the first side edge of the sun-shielding portion and the other band is attached at one of its two ends to the second side edge of the sun-shielding portions;

the unattached ends of the two bands having connecting devices on them wherein the bands can wrap around a wearer's wrist and join together to form a securely closed circle, whereby when the sun-shielding device is connected by a wearer, the palm side of the wearer's hand, fingers, thumb and wrist are covered only by the attachment portions.

2. A sun-shielding device according to claim 1 wherein a strip of material is added to cross over the palm side of the hand covering portion, and wherein one of the two ends of the strip is attached to the first side edge of the hand portion where the hand covering portion cores the area of the back of the hand between the proximate end of the fingers and the proximate end of the thumb and the other end of the strip is attached to the second side edge of the sun-shielding portion where the hand covering portion covers the area of the back of the hand between the proximate end of the fingers and the wrist, whereby, when the sun-shielding device is donned by a wearer, the added strip crosses over the palm of the wear's hand.

3. A sun-shielding device according to claim 1 wherein the cap, strip, and band attachment portions are made of a flexible cloth-like material.

4. A sun-shielding device according to claim 1 wherein the sun-shielding portion is made of a flexible cloth-like material which impedes the passage of light and radiation from the sun.

5. A sun-shielding device according to claim 1 wherein the sun-shielding portion is made of a flexible film of material which impedes the passage of light and radiation from the sun.

6. A sun-shielding device for protecting a wearer's hand having a back and a palm, four fingers and a thumb, said device having a hand portion, four finger portions, a thumb portion and a wrist portion, said thumb and finger portions each having a proximate end where they join the hand portion and a distal end proximate a wearer's fingertips when the device is placed on a wearer's hand, said device comprising a sun-shielding portion and cap, strip, and band attachment portions which aid in holding the sun-shielding portion on the hand, said sun-shielding portion being made of material which impedes the passage of light and radiation from the sun and sized and shaped to entirely cover only the back of the wearer's hand, the backs of the wearer's fingers, thumb, and the back of a wearer's wrist, each of the portions covering the back of the wearer's hand, the backs of the fingers and the thumb and the back of the wrist having first and second side edges; wherein each of the portions for covering the fingers and thumb has, at its distal end, a cap which encloses the tip of the finger or thumb and extends from the distal end toward the proximal end, terminating at a point about one-half inch from the distal end;

each of the finger and thumb portions also having in a space between the cap and the proximate end of the portion for covering the finger or thumb, a circular strip of material which is attached to each respective portion which covers a finger or thumb so that when the glove is worn each circular strip encircles a finger or thumb, said strips crossing over the palm side of the wearer's fingers and thumb when the glove is being worn; and the wrist portion of the sun-shielding portion having two bands, each band having two ends, wherein one band is attached at one of its two ends to the first side edge of the sun-shielding portion and the other band is attached at one of its two ends to the second side edge of the sun-shielding portion;

the unattached ends of the two bands having connecting devices on them wherein the bands can wrap around a wearer's wrist and join together to form a securely closed circle, whereby when the sun-shielding device is donned by a wearer, the palm side of the wearer's hand, fingers, thumb and wrist are covered only by the attachment portions.

7. A sun-shielding device according to claim 6 wherein a strip of material is added to cross over the palm side of the sun-shielding portion, and wherein one of the two ends of the strip is attached to the side edge of the sun-shielding portion where it covers the area of the back of the hand between the proximate end of the fingers and the proximate end of the thumb and the other end of the strip is attached to the opposite side edge of the sun-shielding portion where it covers the area of the back of the hand between the proximate end of the fingers the wrist, whereby, when the sun-shielding device is put over a hand, the strip will cross over the palm of the hand.

8. A sun-shielding device according to claim 6 wherein each cap which encloses the tip of a finger or thumb, each strip which encircles a finger or thumb, and the bands which enclose the wrist of a wearer are made of a flexible cloth-like material.

9. A sun-shielding device according to claim 6 wherein the sun-shielding portion is made of a flexible cloth-like material which impedes the passage of light and radiation from the sun.

10. A sun-shielding device according to claim 6 wherein the sun-shielding portion is made of a flexible film of material which impedes the passage of light and radiation from the sun.

* * * * *